United States Patent [19]

Gibstein et al.

[11] 4,332,007

[45] May 25, 1982

[54] UTILITY LIGHT

[75] Inventors: Edward Gibstein; Jeffrey Nortman, both of New York, N.Y.

[73] Assignee: JEDCO Products Limited, Inc., New York, N.Y.

[21] Appl. No.: 194,412

[22] Filed: Oct. 6, 1980

[51] Int. Cl.[3] ..... F21L 7/00

[52] U.S. Cl. ..... 362/200; 362/103; 362/156

[58] Field of Search ..... 362/200, 205, 156, 103, 362/140, 31

[56] References Cited

U.S. PATENT DOCUMENTS 3,345,508 10/1967 Chung ..... 362/200

4,091,443 5/1978 Ohrenstein ..... 362/156

*Primary Examiner*—Donald P. Walsh

*Attorney, Agent, or Firm*—Steven H. Bazerman

[57] ABSTRACT

A miniature utility light which can be detachably fastened in a handbag, pocketbook or articles of wearing apparel, or to the glove compartment of an automobile, or other items, so as to provide high intensity illumination enabling the user to perform operations at night, such as looking for keys, cosmetics, coins and other items difficult to locate in the dark. Specifically, at least one miniature battery is placed between an opaque and a clear plastic cover cooperating to form the case. Two lightbulbs are located with one bulb on each side of the battery so as to provide illumination through the cover and from the sides thereof. The clear cover has a serrate inner surface and has a pair of angled tabs which engage the opaque cover. The case also has mounted therein an externally accessible switch for selectively energizing and de-energizing the lightbulbs. VELCRO fastening strips are affixed to the outer surface of the opaque cover for detachably securing the light to a handbag or other article.

1 Claim, 6 Drawing Figures

UTILITY LIGHT

BACKGROUND OF THE INVENTION

This invention relates to a miniature flashlight having enhanced illumination and a VELCRO backing. This enables the flashlight to be used for divers applications and particularly enables the flashlight to be transferred from pocketbook to pocketbook.

Lights which may be attached to handbags and other articles are well known and are shown in U.S. Pat. No. D170,139, U.S. Pat. No. 2,400,974 and U.S. Pat. No. 4,091,443. Some of the lights disclosed in these patents are generally flat. In addition to these references, U.S. Pat. No. 1,511,046 and U.S. Pat. No. 3,731,077 show various light structures comprising plural lightbulbs.

However, none of the known prior art devices offers the unique features of the miniature flashlight disclosed herein, viz. utilization of at least a pair of lightbulbs juxtapositioned on either side of the power source within a casing, the top of the casing being clear plastic with a serrate inner surface and the bottom of the casing being opaque plastic with a VELCRO strip on its outer surface.

SUMMARY AND OBJECTS OF THE INVENTION

An object of this invention is to provide a miniature utility light of high intensity illumination and light dispersement which can be detachably affixed to various articles thereby enabling the user to use both hands to perform various operations at night.

Its primary object is its use in a handbag or pocketbook to enable the user to locate keys, cosmetics, coins and other objects which may be carried in the handbag or pocketbook. The miniature light is detachably affixed to the handbag or pocketbook and is easily transferable from one handbag to another.

A further object of this invention is to provide a miniature light having high intensity illumination within a casing of designer quality and fashion and which is suitable to be carried in a handbag or pocketbook for any occasion.

Another object of the present invention is to provide a miniature utility light wherein assembly of a minimum number of structural parts is accomplished in a minimal amount of time by minimally skilled assemblers.

Additional objects and features of the invention will appear from the following description in which the preferred embodiment has been set forth in detail in conjunction with the accompanying drawings.

DESCRIPTION OF THE PREFERRED EMBODIMENT

Figure 1:
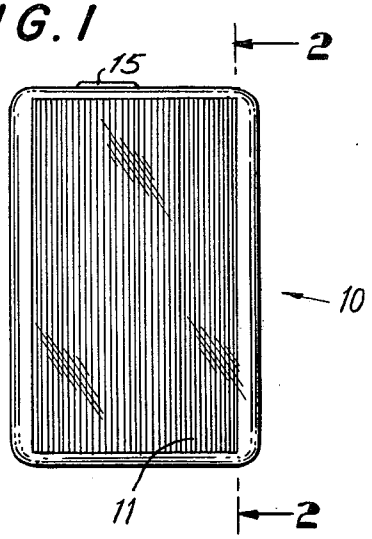
FIG. 1 is a top plan view in actual size of the utility light.

Referring to FIG. 1 of the drawings reference numeral 10 in general indicates the miniature utility light of this invention in actual size. The clear plastic top portion of the casing 11 shows the serrate inner surface 12 of the top portion. Switch means 15 is shown centrally positioned along one side of the casing.

Figure 4:
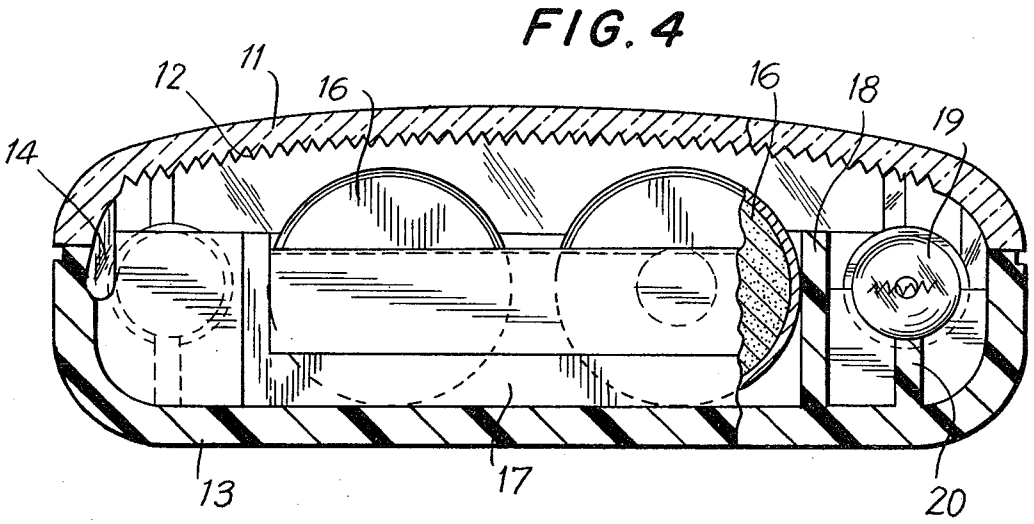
FIG. 4 is an enlarged sectional side view taken generally along somewhat staggered line 4—4 of FIG. 3.
Figure 2:
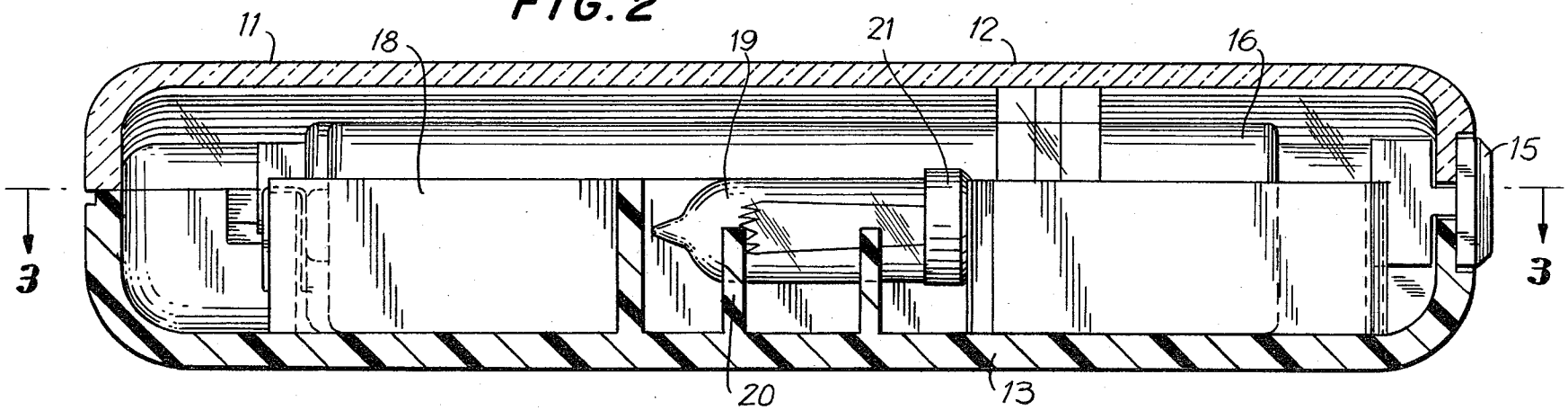
FIG. 2 is an enlarged cross-sectional view taken generally along line 2—2 of FIG. 1.

FIG. 2 shows the top clear plastic portion or section 11 cooperating with and joined to the opaque plastic bottom portion or section 13 to form the outer casing of the miniature flashlight 10. The top compartment 11 has a pair of angled tabs 14 to detachably engage the lower compartment 13 of the casing and locking portions or sections into a unitary casing and better illustrated in FIG. 4. Centrally positioned within the casing is a pair of miniature batteries 16 which are positioned in chamber 17 formed by walls 18 molded as part of lower section 13 and centrally disposed therein. Juxtapositioned on each side of the power source or batteries 16 are a pair of miniature incandescent lamps or lightbulbs 19 which are saddled in a support 20 of the lower section 13 of the casing.

Figure 3:
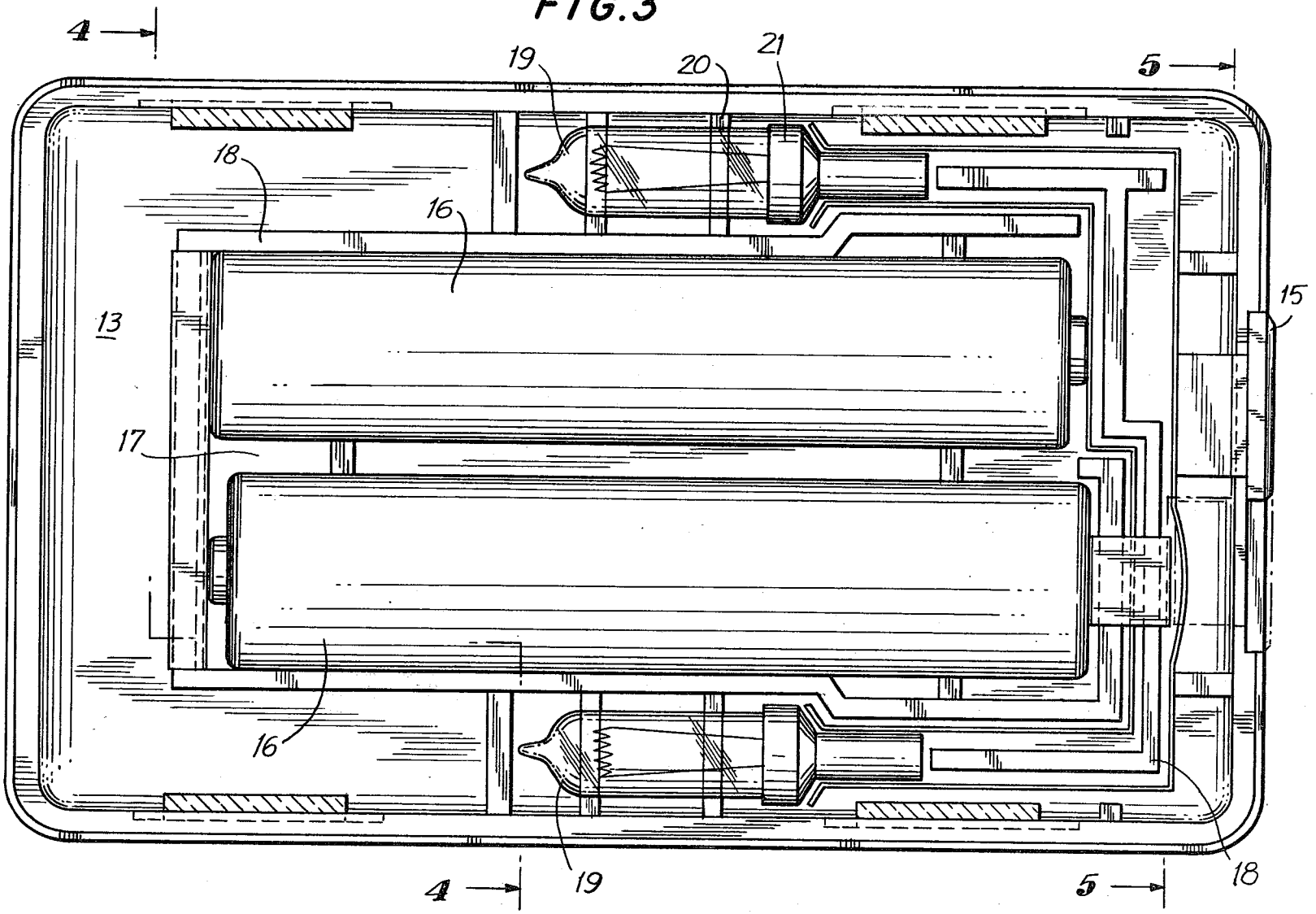
FIG. 3 is an enlarged plan view of the utility light with the top portion of the case removed taken generally along line 3—3 of FIG. 2.
Figure 5:
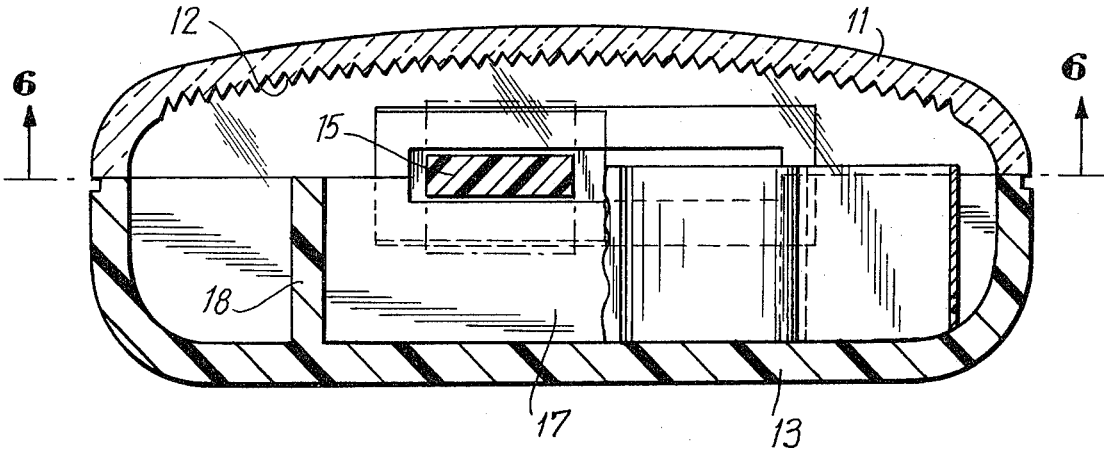
FIG. 5 is an enlarged sectional side view taken generally along somewhat staggered line 5—5 of FIG. 3.

FIG. 2 and FIG. 3 show the relationship of the lightbulbs 19 to the batteries 16 or power source. Lightbulbs 19 are secured in miniature sockets 21. The unit is provided as common to all flashlights with electrical means (not shown) for connecting the power source 16 to the light source 19 and with connections (not shown) with a slide button or switch means to actuate the light source 19 as exemplified by slide button 15 and better illustrated in FIG. 5. Not shown is a fastening strip affixed to the outer surface of bottom portion or compartment 13. Preferably this fastening strip is VELCRO (the registered trademark of American Velcro, Inc. for separable tape fasteners). This enables the light to detachably affix to the inside of a pocketbook or other article with the illumination from the light directed to and concentrated in the desired location.

Figure 6:
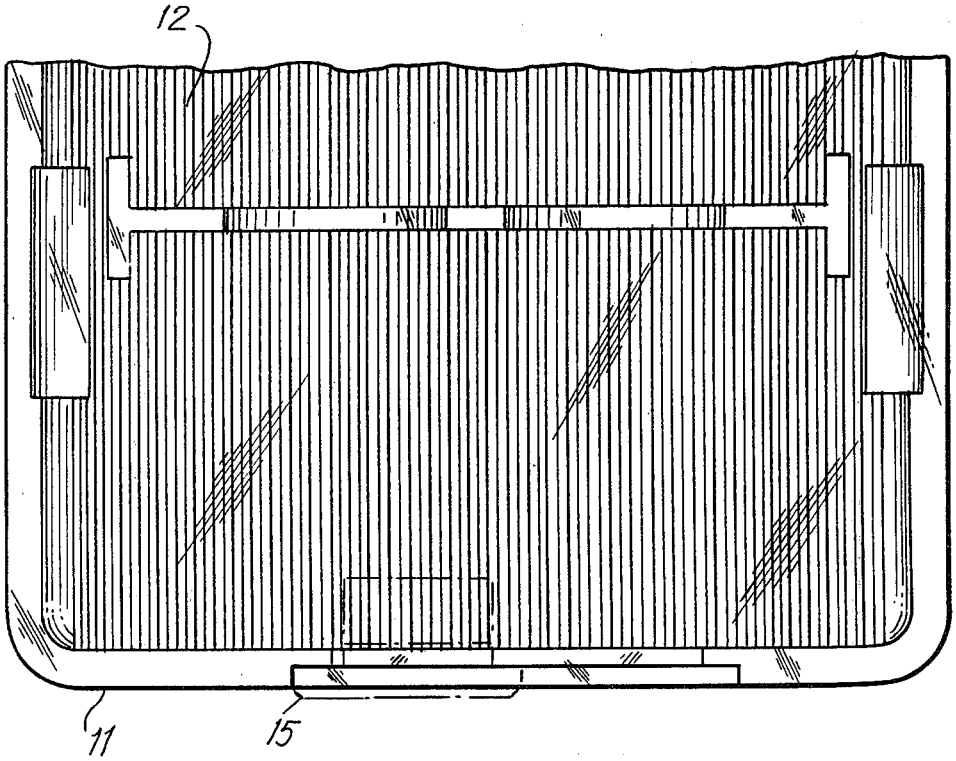
FIG. 6 is a fragmentary plan view of the inner surface of the removed top portion of the case taken generally along lines 6—6 of FIG. 5.

FIG. 6 illustrates the serrate inside surface 12 of the clear plastic top portion 11 of the case. The clear top portion 11 and the opaque bottom portion 13 are molded from polystyrene but any number of moldable plastics can be used.

The case is generally rectangular with the thickness being slightly greater than the thickness of the battery or power source being used.

In order to achieve maximum illumination at least one pair of lightbulbs must be juxtapositioned on either side of the power source 16 although it is understood that multiple pairs of said lightbulbs may be used. However, because of the flat miniature size of the light and the illumination provided through the clear upper compartment and from the sides of the case by a single pair of lightbulbs in combination with the serrate inner surface of the clear upper compartment of said case, we prefer to use one pair of said lightbulbs.

Although the present invention has been illustrated and described with reference to preferred embodiments thereto, it would be understood that it is by no means limited to the details of such embodiments but is capable of numerous modifications within the scope of the appended claims.

We claim:

1. A flat miniature flashlight intended to be detachably secured to an article, comprising:

(a) an outer plastic casing having an opaque lower compartment and a clear upper compartment cooperating to form said casing, said upper compartment having a serrate inner surface and a pair of angled tabs which detachably engage the lower compartment, said upper compartment having a substantially flat major surface and adjacent side portions;

(b) a power source comprising at least one replaceable battery centrally positioned in said casing;

(c) a light source comprising a pair of replaceable electric bulbs within said casing juxtapositioned on either side of the battery and supported by the lower compartment so as to provide illumination through the clear upper compartment and from the side portions thereof;

(d) electrical means for connecting the power source to the light source;

(e) switch means for actuating the light source; and (f) VELCRO means affixed to the outer surface of the opaque lower compartment for detachable securing the flashlight to an article.

* * * * *